US006827554B2

(12) United States Patent
Caruso et al.

(10) Patent No.: US 6,827,554 B2
(45) Date of Patent: Dec. 7, 2004

(54) AXIAL ENTRY TURBINE BUCKET DOVETAIL WITH INTEGRAL ANTI-ROTATION KEY

(75) Inventors: David Alan Caruso, Ballston Lake, NY (US); James Harvey Vogan, Schenectady, NY (US); Dennis W. Roberts, Schenectady, NY (US); Kiernan Francis Ryan, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 60 days.

(21) Appl. No.: 10/372,169

(22) Filed: Feb. 25, 2003

(65) Prior Publication Data

US 2004/0165989 A1 Aug. 26, 2004

(51) Int. Cl.[7] ..... F01D 5/30
(52) U.S. Cl. ..... 416/191; 416/220 R; 416/248
(58) Field of Search ..... 416/191, 212 A, 416/219 R, 204 A, 220 R, 248

(56) References Cited

U.S. PATENT DOCUMENTS 4,702,673 A * 10/1987 Hansen et al. ..... 416/215
5,002,288 A * 3/1991 Morrison et al. ..... 277/413
5,494,408 A 2/1996 Seeley et al.
5,509,784 A * 4/1996 Caruso et al. ..... 416/222
6,190,131 B1 * 2/2001 Deallenbach ..... 416/144
6,416,286 B1 7/2002 Roberts et al.
6,428,270 B1 * 8/2002 Leone et al. ..... 415/115

* cited by examiner

*Primary Examiner*—Hoang Nguyen
(74) *Attorney, Agent, or Firm*—Nixon & Vanderhye P.C.

(57) ABSTRACT

Axial entry dovetails on buckets are installed axially into generally complementary-shaped female dovetails about the rim of the turbine wheel. The buckets include bucket covers having an interference fit such that upon installation, the buckets tend to rotate, which causes radial inward displacement of the buckets. To eliminate the bucket rotation and radial displacement, the male dovetails mount an anti-rotation key for reception in a generally complementary-shaped recess at the base of the female dovetail. The anti-rotation key in the slot eliminates rotation and radial displacement of the bucket, maintaining the buckets on radii and enables the bucket covers to be machined to proper diameters.

14 Claims, 3 Drawing Sheets

AXIAL ENTRY TURBINE BUCKET DOVETAIL WITH INTEGRAL ANTI-ROTATION KEY

BACKGROUND OF THE INVENTION

The present invention relates to axial entry dovetail connections between a turbine wheel and turbine buckets and particularly relates to a complementary anti-rotation key and recess on the axial entry bucket and wheel dovetails, respectively, to minimize or eliminate rotation of the bucket dovetail in the wheel slot.

For axial entry turbine bucket-to-wheel connections, each bucket typically includes a male dovetail extending in an axial direction and having a plurality of hooks along opposite sides. Female dovetail slots are provided at circumferentially spaced locations about the margin of the turbine wheel and receive the male dovetails of the buckets in an axial direction to secure the buckets and wheel to one another. Pins or other devices are conventionally used to finally secure the buckets and wheel to one another. Oftentimes, each bucket includes a bucket cover and certain turbine buckets have a steep angle integral cover. A steep angle bucket cover has lateral edges facing in a circumferential direction for mating with correspondingly-shaped edges of adjacent covers. By steep angle is meant that the lateral edges have a steep angle relative to the direction of rotation of the bucket, i.e., forms an acute angle with a tangent of the bucket. In bucket covers having a generally Z-shaped configuration along their opposite edges, the intermediate portion of the Z-shaped edge manifests this steep angle relative to a tangent. When buckets of this type having steep angle integral covers are assembled onto the wheel, second and subsequent buckets being installed cause an interfering contact between the steep angle edges of the bucket cover being installed and the previously installed adjacent bucket cover. This interference prevents the bucket from full axial insertion and, accordingly, a force is typically applied to complete axial insertion of the bucket dovetail into the wheel dovetail. This force tends to twist or apply a torque to the bucket along its outer periphery, which twist is transmitted through the airfoil to the bucket dovetail. This transmitted twisting or torque causes the male dovetail on the bucket to engage along the crush surfaces of the female dovetail, causing both a radial inward movement of the bucket, as well as a twisting motion to the bucket. The radial inward movement causes an overall reduction in the diameter of the bucket covers upon completing assembly of the buckets onto the wheel. This causes a problem when the bucket covers are machined to the designed diameters subsequent to bucket installation. When the turbine comes up to speed in operation, the buckets will, under centrifugal forces, move radially outwardly so that the bucket dovetail hooks seat on the crush surfaces of the wheel dovetails. The bucket covers will thus ride closer to the spill strips and may cause rubs. Also, because of this twisting action upon assembly, the buckets may not lie on a radial line and can easily pivot about the dovetail in a tangential direction. If machined off the radial line, then when the turbine comes up to speed, the buckets will seat themselves on the radial line, causing steps to appear between the bucket covers.

One method of enabling machining of the covers to the correct diameter upon installation of the buckets on the wheel is to insert metal shims under the bottom of each dovetail during assembly. This maintains the buckets radially outwardly in engagement with the crush surfaces of the female dovetails. Thus, while the diameter of the bucket covers can be machined properly using shims, the shims must be removed before shipping the rotor and their removal also requires removal of the buckets, which is a time-consuming task. Accordingly, there is a need for a mechanism to maintain the buckets from rotating on the crush surfaces upon installation of the buckets and on a radial line during cover machining.

BRIEF DESCRIPTION OF THE INVENTION

In accordance with a preferred embodiment of the present invention, there is provided turbine buckets having axial entry male dovetails and steep angle integral covers wherein the bucket dovetails include an anti-rotation key for minimizing or eliminating any tendency of the bucket dovetail to rotate in the wheel slot in response to interference fits between adjacent covers, enabling machining of the cover profiles to the designed diameters. Particularly, an anti-rotation key and a corresponding recess are provided at the bases of the each male dovetail and female dovetail slot, respectively, which minimizes or eliminates tendency of the buckets to rotate due to an interference between the adjacent covers upon installation of the buckets. The key at the base of each male dovetail comprises a radial inwardly extending projection or lug, preferably extending the axial full length between end faces of the bucket dovetail. Correspondingly, the recess in each female dovetail-shaped slot extends preferably between opposite end faces of the wheel. By providing tight tolerances between opposite sides of the lug and side walls of the recess, any tendency of the bucket dovetail to rotate in the female slot upon axial insertion is substantially eliminated. Thus, radial inward and off-radial line movements of the bucket are precluded upon installation of the buckets.

In a preferred embodiment according to the present invention, there is provided a rotor wheel assembly comprising a rotor wheel having a plurality of circumferentially spaced, axial entry, female dovetail-shaped slots about a margin of the wheel, a plurality of buckets, each having an axial entry male-shaped dovetail generally complementary to the female dovetail-shaped slot for reception in the female dovetail-shaped slot, each slot including a base having a recess radially inwardly of the base and opening through at least one end face of the wheel and radially outwardly into the female dovetail-shaped slot, each male-shaped dovetail having a key projecting radially inwardly from a base of the male-shaped dovetail and received in the recess, the key and walls defining the recess in the base being cooperable to preclude rotation of the bucket generally about a radius of the wheel passing through the bucket.

In a further preferred embodiment according to the present invention, there is provided a rotor wheel assembly comprising a rotor wheel having a plurality of circumferentially spaced, axial entry, female dovetail-shaped slots about a margin of the wheel, a plurality of buckets, each having an axial entry male-shaped dovetail generally complementary to the female dovetail-shaped slot for reception in the female dovetail-shaped slot, each slot including axially extending opposite side walls having flat parallel surfaces opening through at least one end face of the wheel, each male-shaped dovetail having axially extending opposite side walls having flat parallel surfaces, the flat surfaces of the male-shaped dovetail and the flat surfaces in the slot being cooperable to preclude rotation of the bucket generally about a radius of the wheel passing through the bucket.

DETAILED DESCRIPTION OF THE INVENTION

Figure 1:
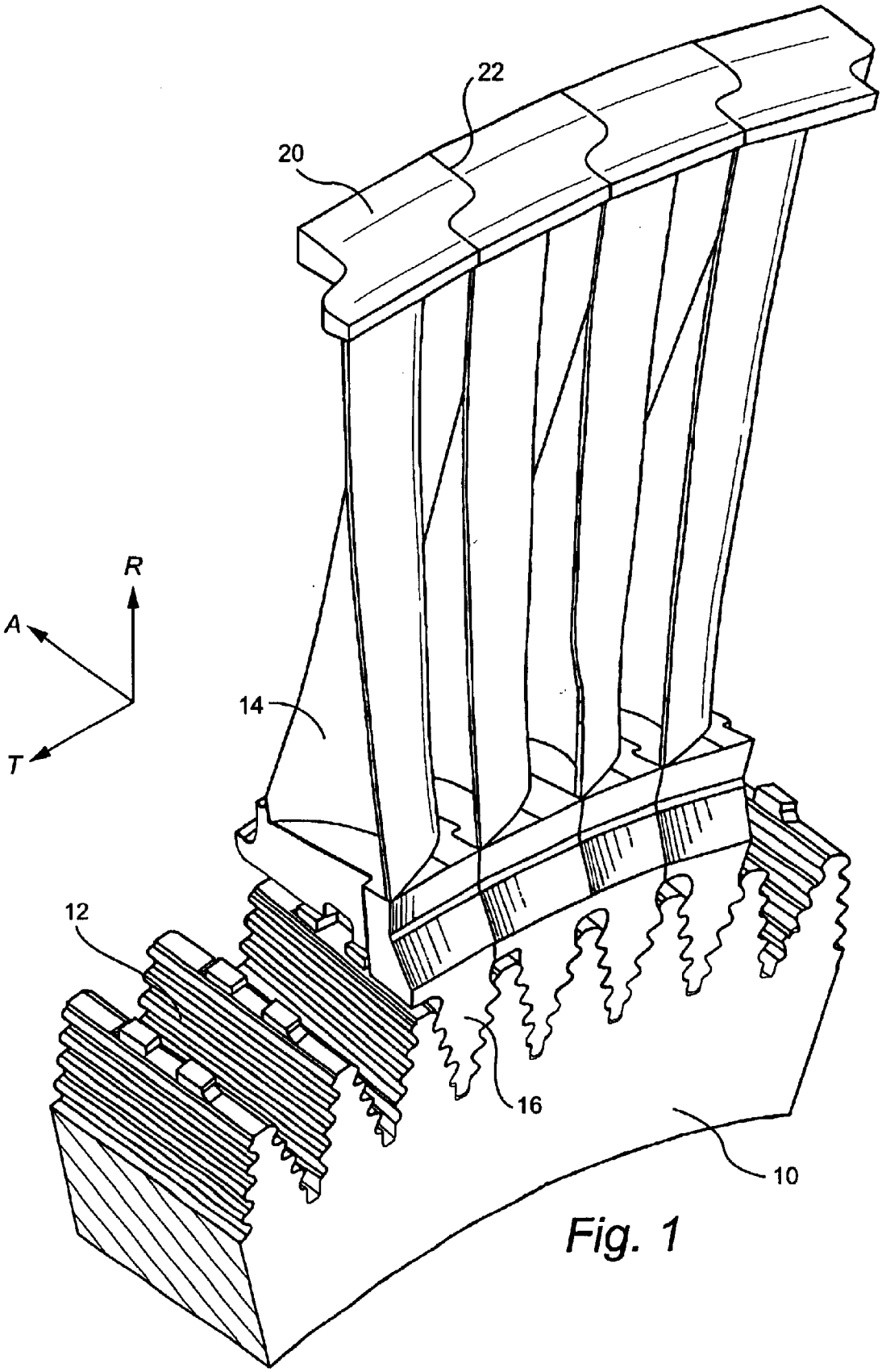
FIG. 1 is a fragmentary perspective view of a portion of a wheel and a plurality of buckets forming part of a turbine and illustrating axial entry dovetail connections between the buckets and wheel.
Figure 4:
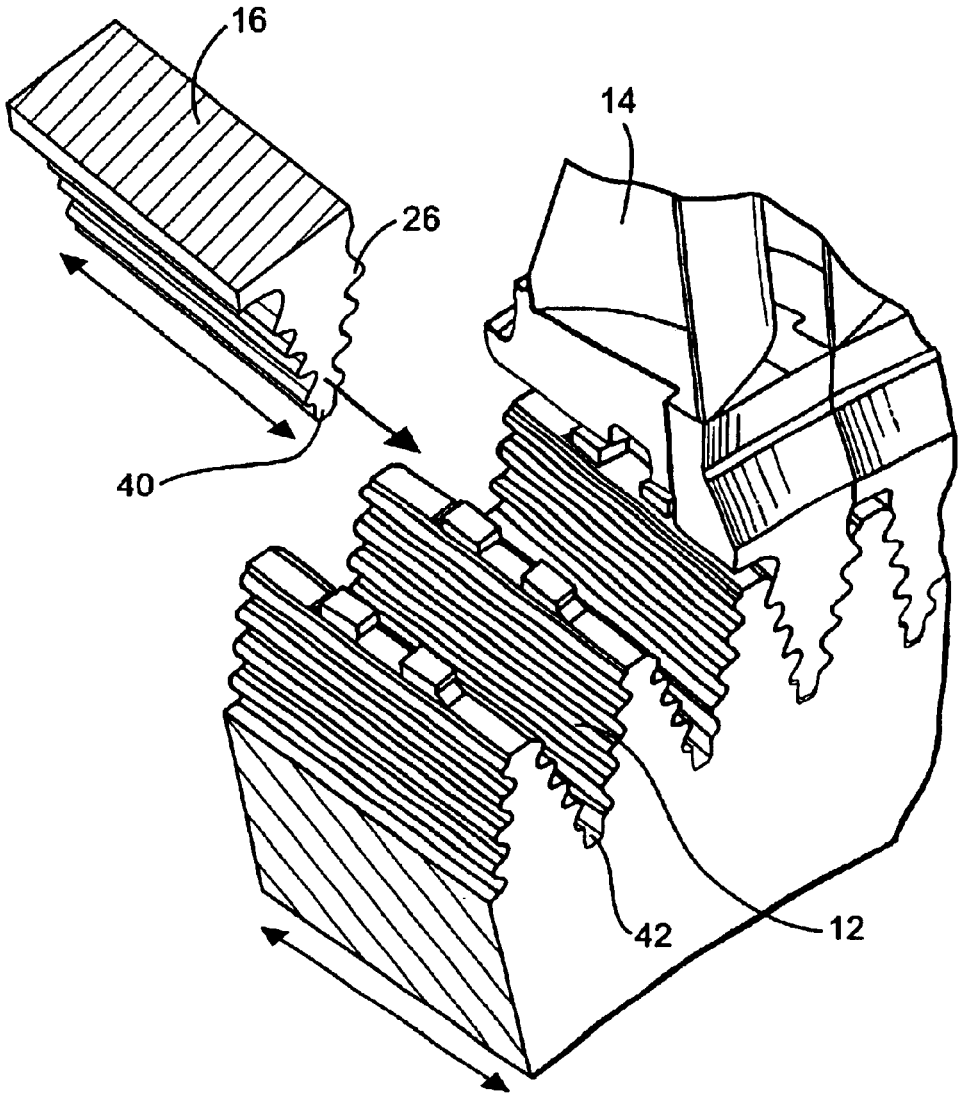
FIG. 4 is a fragmentary view similar to FIG. 1 illustrating the male dovetail portion of a bucket aligned for axial insertion into the female dovetail slot of the wheel.

Referring now to the drawings, particularly to FIG. 1, there is illustrated a portion of a turbine wheel 10 having a plurality of dovetail-shaped slots 12, i.e., female dovetails, spaced circumferentially one from the other about the peripheral margin of wheel 10. Also illustrated are a plurality of buckets 14 each having a radially inwardly extending male dovetail 16 generally complementary in shape to the female dovetail-shaped slot 12. The female and male dovetails 12 and 16, respectively, are aligned in an axial direction of the turbine such that the buckets can be installed on the wheel 10 by displacing the bucket dovetails 16 into the female dovetail-shaped slots 12 in the axial direction as illustrated in FIG. 4. Thus, the buckets will form an array of buckets about the rim of the wheel. In FIG. 1, there is illustrated a Cartesian coordinate system designated A, T and R, representing axial, tangential and radial directions vis-à-vis the turbine wheel 10 and buckets 14.

Figure 3:
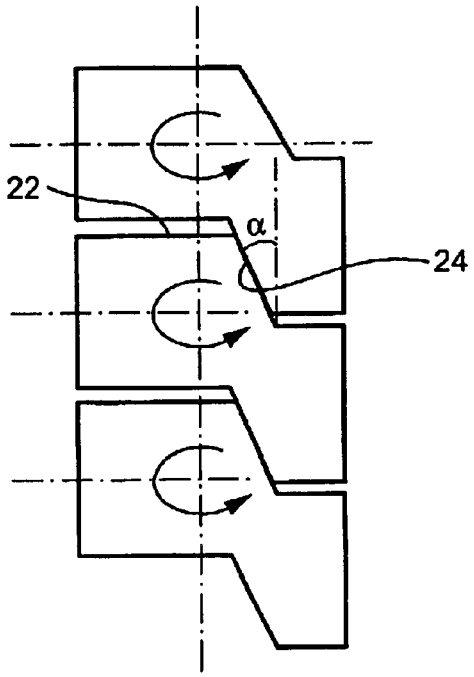
FIG. 3 is a radial inward view illustrating the configuration of the bucket covers in assembly.

The buckets 14 also include bucket covers 20. The circumferentially facing margins or edges 22 of each bucket cover 20 has a generally Z-shaped configuration when viewed in a radial inward direction, as illustrated in FIG. 3. The edges 22 thus have intermediate edges 24 which are at a steep angle in the direction of rotation of the rotor of the turbine, i.e., form an acute angle $\alpha$ with a tangent along the bucket cover. Consequently, upon axial insertion of each bucket in sequence about the rotor, the steep angle intermediate edge 24 of the bucket being inserted abuts the steep angle edge 24 of the installed adjacent bucket. As explained above, the tight-fitting arrangement of the bucket covers causes an interference between the adjoining edges 24, tending to rotate the bucket being installed generally about a radial axis upon installation. The tendency of the buckets to twist or rotate about this generally radial axis, as illustrated by the arrows in FIG. 3, is transmitted through the blade of the bucket to the male dovetail 16.

Figure 2:
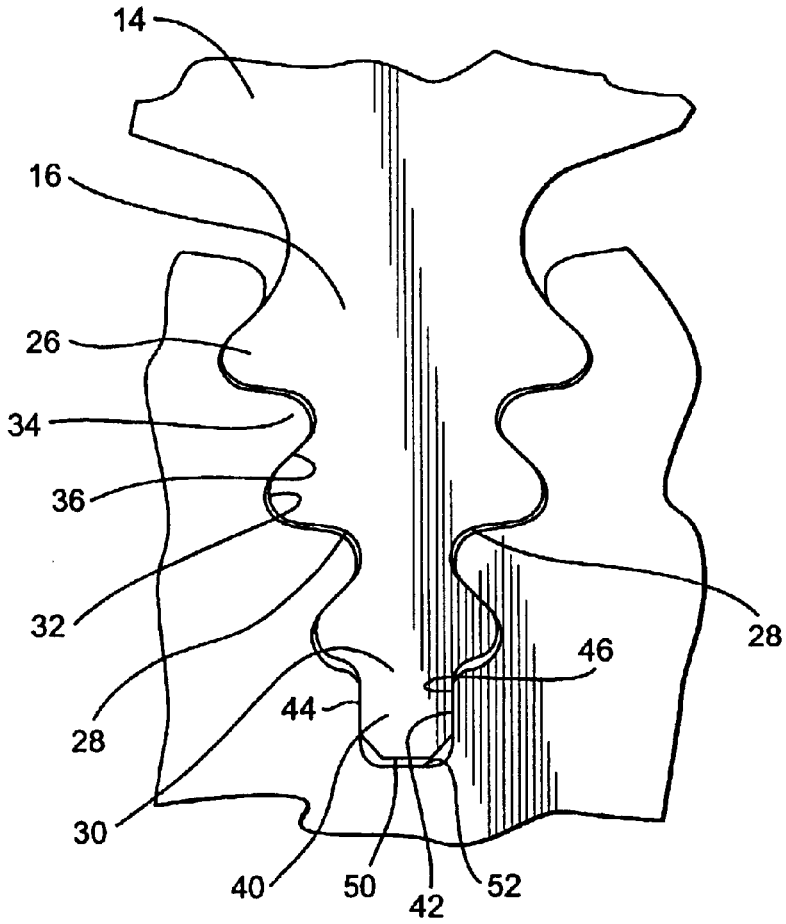
FIG. 2 is a fragmentary enlarged end face elevational view of the male dovetail of a bucket in a female dovetail slot of the wheel.

Referring more particularly to FIG. 2, the male dovetail 16 includes a plurality of laterally oppositely directed hooks 26, three hooks 26 on the male dovetail 16 being illustrated. Fillets 28 are provided between the hooks 26. The male dovetail 16 necks down in a radial inward direction, terminating in a radial inward base portion 30. The female dovetail slots 12 are generally complementary in shape to the male dovetail 16 and each includes hooks 34 having crush surfaces 36 underlying the hooks in a radial inward direction. As explained previously, the sequential axial insertion of the buckets causes edges 24 of the covers to interfere with one another, tending to rotate or torque the buckets upon further axial insertion. That tendency to rotate or torque the bucket causes the hooks 26 to ride along the opposite crush surfaces 36, in turn causing a radial inward movement of the bucket relative to the wheel. The radial inward movement causes a change in diametrical dimension across the covers of the assembled buckets and wheel which causes difficulty in machining the covers to the proper diameter. Consequently and in accordance with a preferred embodiment of the present invention, the male and female dovetails are provided with complementary keys and recesses, respectively, to prevent rotation and, hence, movement in a radial direction.

To accomplish the foregoing, the male dovetail 16 includes a radial inward projection or key 40 extending along the base 30 of the dovetail 16 and formed integrally with the male dovetail 16. In a corresponding manner, the base of the female slot 12 is provided with a radially inwardly directed recess 42. While the key 40 and recess 42 may extend from one end face of each bucket and wheel toward the opposite end faces thereof, terminating short of such opposite end faces, it is preferable that the keys 40 and recesses 42 are coextensive in length and extend between opposite end faces of the buckets and wheel, respectively. With tight tolerances between the side walls of the keys 40 and recesses 42, for example, a tolerance of 0.002 inches, it will be appreciated, that any tendency of the bucket dovetail to rotate in the female slot 12 is eliminated by engagement of the side walls of the lug with the side walls of the recess. That is, the flat parallel axial extending side wall surfaces 44 of each bucket dovetail engages with tight tolerances the flat parallel axial extending side wall surfaces 46 of each wheel slot to preclude rotation of the bucket generally about a radius of the wheel passing through the bucket. As illustrated, the radial inner faces 50 of the keys 40 are spaced from the bottoms 52 of the recesses 42. However, the interaction of the sides of the keys and the recesses eliminates any rotation of the bucket and, hence, also eliminates any movement of the buckets in radial directions and offline from their radii.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotor wheel assembly comprising:

a rotor wheel having a plurality of circumferentially spaced, axial entry, female dovetail-shaped slots about a margin of the wheel, each of said female slots having a plurality of hooks extending axially along opposite sides thereof and projecting toward one another;

a plurality of buckets, each having an axial entry male-shaped dovetail generally complementary to said female dovetail-shaped slot for reception in said female dovetail-shaped slot, each said male dovetail having a plurality of hooks extending axially alone opposite sides thereof and extending away from one another;

each said slot including a base defining a recess radially inwardly of radially innermost hooks of the female dovetail shared slot and opening through at least one end face of the wheel and radially outwardly;

each said male-shaped dovetail having a key projecting radially inwardly from a base of said male-shaped dovetail at a location radially inwardly of radially innermost hooks carried thereby and received in said recess, said key and walls defining said recess in said base slot being cooperable to preclude rotation of said bucket generally about a radius of the wheel passing through the bucket.

2. An assembly according to claim 1 wherein said keys are formed integrally with said male-shaped dovetails.

3. An assembly according to claim 1 wherein said side walls of said recesses and side walls of said keys extend linearly in an axial direction.

4. An assembly according to claim 1 wherein each said recess extends between opposite end faces of the wheel.

5. An assembly according to claim 4 wherein said key extends between opposite end faces of each bucket dovetail.

6. An assembly according to claim 5 wherein said recess extends between opposite end faces of the wheel.

7. An assembly according to claim 1 wherein said side walls of said recesses and side walls of said keys extending linearly in an axial direction, each said recess extending between opposite end faces of the wheel and each said key extending between opposite end faces of the bucket dovetail.

8. An assembly according to claim 1 including a cover on each said bucket having circumferentially spaced edges having a generally Z-shaped configuration.

9. A rotor wheel assembly comprising:

a rotor wheel having a plurality of circumferentially spaced, axial entry, female dovetail-shaped slots about a margin of the wheel;

a plurality of buckets, each having an axial entry male-shaped dovetail generally complementary to said female dovetail-shaped slot for reception in said female dovetail-shaped slot;

each said slot including axially extending opposite side walls having flat parallel surfaces opening through at least one end face of the wheel;

each said male-shaped dovetail having axially extending opposite side walls having flat parallel surfaces, the flat surfaces of said male-shaped dovetail and the flat surfaces in said slot being cooperable to preclude rotation of said bucket generally about a radius of the wheel passing through the bucket.

10. An assembly according to claim 9 wherein said flat surfaces of said buckets extend axially between opposite end faces of the buckets.

11. An assembly according to claim 9 wherein said flat surfaces of said wheel slot extend between opposite end faces of each wheel.

12. An assembly according to claim 11 wherein said flat surfaces of said buckets extend axially between opposite end faces of the buckets.

13. An assembly according to claim 9 including a cover on each said bucket having circumferentially spaced edges having a generally Z-shaped configuration.

14. An assembly according to claim 9 wherein said axially extending flat side wall surfaces of each said male-shaped dovetail form a radial inwardly projecting key formed integrally with each said male-shaped dovetail and received within a recess formed by the flat parallel surfaces of said female dovetail-shaped slot.

* * * * *

UNITED STATES PATENT AND TRADEMARK OFFICE

CERTIFICATE OF CORRECTION

PATENT NO. : 6,827,554 B2
DATED : December 7, 2004
INVENTOR(S) : Caruso et al.

It is certified that error appears in the above-identified patent and that said Letters Patent is hereby corrected as shown below:

Column 4,
Line 52, after "axially" delete the word "alone" and insert the word -- along --
Line 56, after "dovetail" delete the word "shared" and insert the word -- shaped --

Signed and Sealed this

Eighth Day of March, 2005

JON W. DUDAS
*Director of the United States Patent and Trademark Office*